US008308888B1

(12) United States Patent
Stover et al.

(10) Patent No.: US 8,308,888 B1
(45) Date of Patent: Nov. 13, 2012

(54) SYSTEM TO MAKE A BALLISTIC MATERIAL

(75) Inventors: Robert Scott Stover, Tempe, AZ (US); Paul Mark Merriman, Houston, TX (US)

(73) Assignee: Hisco, Inc., Houston, TX (US)

( * ) Notice: Subject to any disclaimer, the term of this patent is extended or adjusted under 35 U.S.C. 154(b) by 1608 days.

(21) Appl. No.: 11/737,590

(22) Filed: Apr. 19, 2007

(51) Int. Cl.
*F41H 5/04* (2006.01)

(52) U.S. Cl. ..... 156/242; 156/555; 156/500; 156/501; 156/510

(58) Field of Classification Search ..... 156/242
See application file for complete search history.

(56) References Cited

U.S. PATENT DOCUMENTS 4,460,429 A * 7/1984 Coscia et al. ..... 156/384

* cited by examiner

*Primary Examiner* — Philip Tucker
*Assistant Examiner* — Vicki Wu
(74) *Attorney, Agent, or Firm* — Buskop Law Group, PC; Wendy Buskop

(57) ABSTRACT

A system for making a ballistic material resistant to penetration from bullets, shrapnel, debris, and other lethal missiles, comprising: means for dyeing a flexible conformable low surface energy fabric; a roll coating device for continuously coating a top surface of the dyed fabric with an acrylic based adhesive; an extruder for applying a liner; at least one nip roller for receiving the liner and the coated fabric and applying the liner to the coated fabric; at least one displacement slitter for cutting the coated lined fabric; a fabric printer for printing the cut lined fabric with a fast drying acrylic ink forming a ballistic material up to 300% thicker than the flexible conformable low surface energy fabric; and a continuous cutter for cutting the ballistic material into a desired shape.

11 Claims, 1 Drawing Sheet

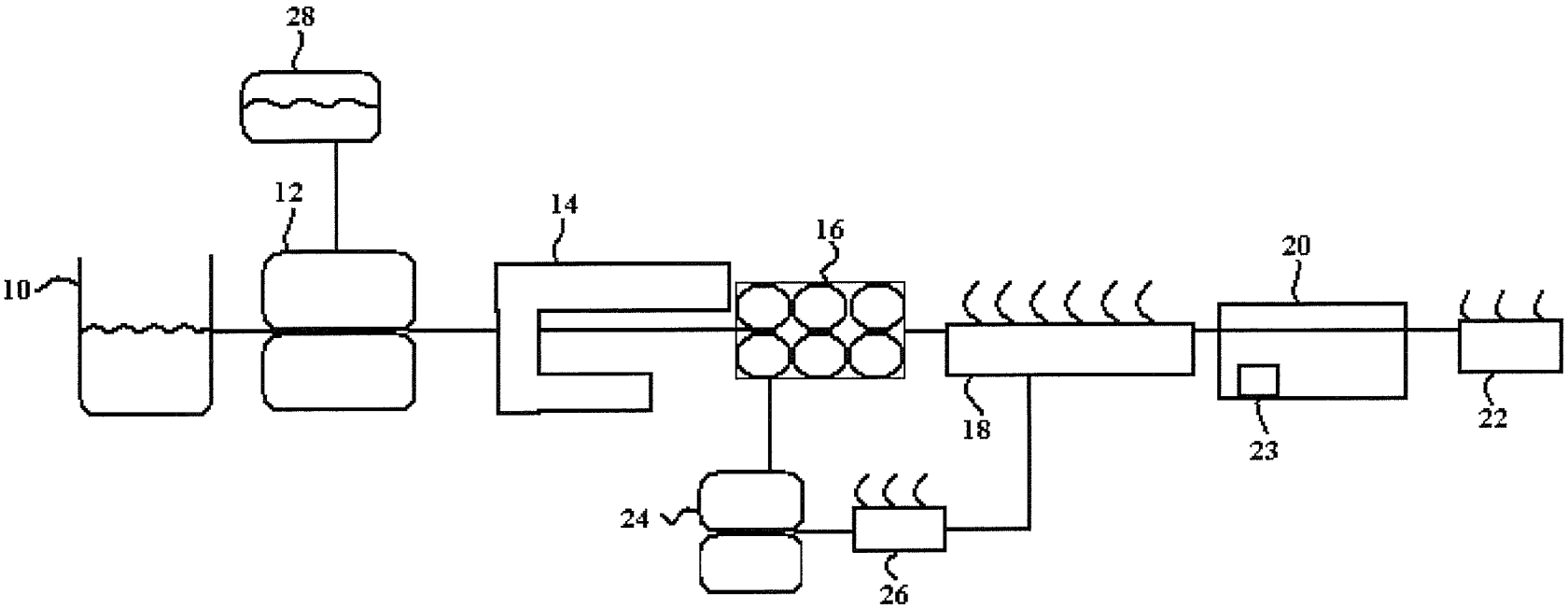
22
20
23
18
26
16
24
14
28
12
10

SYSTEM TO MAKE A BALLISTIC MATERIAL

FIELD

The present embodiments relate to a system for making a fabric usable for external body armor that protects policemen, soldiers, and others that might experience injury due to fragmentation from explosives or other materials, or might experience a bullet or firearm-related injury.

BACKGROUND

A need exists for a system for making a ballistic material capable of faster production than currently available techniques that provides a high quality material and consistent results.

A need exists for a system for making a ballistic material or fabric using an adhesive having a very fast cure time.

A need exists for a system for making a ballistic material that can be used as a spall cover for personal wearable body armor and for military vehicle and aircraft seating.

A need exists for a system to make a ballistic material that can be used for tents, covers, and tarps that is strong, usable with other substrates, and can be effective to prevent flying debris from reaching inhabitants of a structure.

A need exists for a system for making a ballistic material that can be used to help protect wind power turbines and solar panel backing, in addition to armor plate covers for personal body armor, fighter pilot seating, helicopter seating, and vehicle seating, including military vehicle and aircraft seating.

The present embodiments meet these needs.

BRIEF DESCRIPTION OF THE DRAWINGS

The detailed description will be better understood in conjunction with the accompanying drawings as follows:

FIG. 1 depicts a contemplated schematic embodiment of the parts of the present system.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that they can be practiced or carried out in various ways.

The present invention relates to a system for making a ballistic material that can be used to cover one or more components of external body armor, such as a side piece or a breast plate of external body armor used by police, Marines, and by other soldiers. The ballistic material can prevent injury caused by fragmentation of the component of body armor, such as when the body armor is impacted by a bullet, shrapnel, debris, or force from an explosive device.

The present invention relates to a system for making a fabric that is a suitable ballistic material that meets the National Institute of Justice Threat Level IIa, National Institute of Justice Threat Level II, national Institute of Justice threat level IIIA, National Institute of Justice Threat level III, and National Institute of Justice Threat level IV.

One advantage of the present system is that the produced ballistic material can be used with a substrate to create a personal body armor component, which enables a completed body armor component to be assembled very quickly in the field, or in factories or other production facilities, in less than one minute, without requiring equipment such as adhesive dispensers, ovens, and ventilation. No solvents or heated platens are needed to press the parts together, enabling fast assembly of the body armor in the field.

The present system can be used to create a ballistic material that can be applied to any substrate as a spall cover. The training and the ramp up time for assembly of body armor using this processed fabric is very short, nearly instantaneous, and no more than five minutes. Spall covers can also be used to cover and protect military vehicle and aircraft seating.

The present system provides a ballistic material that enables the assembly of body armor and other products without the need for any additional mixing, curing, or heating.

The present system provides a ballistic material wherein the creation of scrap is minimized during the assembly of body armor and other products. This provides reduced costs in the assembly of personal body armor and other products, as the ballistic material made by this process is a fabric, which is die cut friendly, having a printable top side and edges that burn and seal cleanly—a unique combination of features.

The present system produces a fabric that is tough, highly resistant to corrosive environments with the added ability to resist impact with particles, such as exploded bomb fragments.

The present system provides a ballistic material through use of a means for dyeing a flexible conformable low surface energy fabric having a thickness of at least three mils, forming a dyed fabric. A roll coating device can be used for continuously coating a top surface of the dyed fabric with an acrylic based adhesive, forming a coated fabric. An extruder can then be used to apply a liner to the coated fabric. One or more nip rollers can receive the liner and the coated fabric simultaneously, and pressurably apply the liner to the coated fabric, forming a coated lined fabric. One or more displacement slitters can be used to cut the coated lined fabric, thereby forming a cut lined fabric. A fabric printer can then print the cut lined fabric with a fast drying acrylic ink, forming a ballistic material up to 300% thicker than that of the original flexible conformable low surface energy fabric.

The system can further include a continuous cutter for cutting the ballistic material into a desired shape.

It is contemplated that various fabrics can be used by the system including polyamides such as nylon, polypropylene, polyethylene or copolymers thereof, such as 70/30 polypropylene-polyethylene blends to 30-70 polypropylene/polyethylene blends. Usable fibers include those known as Twaron™ and microfilaments, such as Dyneema™ available from Allied Signal Company.

This system can use a flat fabric or a textured fabric, including an air textured fabric.

In an embodiment, a coater, such as a roll coating device, can be used to coat the textured fabric with an additional urethane coating.

The system forms a fabric using a high performance acrylic based adhesive to aggressively bond to the flexible conformable low surface energy fabric, such as those described above. The combined components provide a long-lasting fabric with enhanced chemical resistance and increased stability against ultraviolet degradation. The system includes equipment, such as die cutters and laser cutters, to cut the fabric into rolls for easy handling. The fabric retains good quality while remaining inexpensive to produce.

The system places an easy release liner on the adhesive layer. In an embodiment, the system can print on the easy release liner for component tracking and to enable automated proper alignment during the lining step of the fabric.

The system creates a ballistic material that can be used to cover wind turbine backings, tents, and other military fabric based protection devices and structures. It is contemplated that the ballistic material could be used to cover other objects, and even act as a screen-like device to inhibit bullet penetration through a window at a military campsite, or to prevent hurricane debris from breaking frangible structures on residences and commercial buildings.

Initially, the system uses a means for dyeing to dye a flexible conformable low surface energy fabric to a preferred color, such as military green or sand colored, creating a dyed fabric. The dyed fabric can be dyed any color. Any manner of textile or fabric dyeing machines or equipment can be used. The dyeing can be a batch process or a continuous process.

The means for dyeing can receive the initial flexible conformable low surface energy fabric, such as those described above, dye the fabric a desired color, and dry the fabric. It is contemplated that the means for dyeing can be computer controlled, such as by including a processor in wireless communication with a main server of the system.

It is contemplated that the dyed fabric can have a thickness of at least a three mils, but can range in thickness from one mil to 1000 mils. The thickness can be varied as needed for the particular application of the fabric.

It is further contemplated that the flexible conformable low surface energy fabric can be a polyamide, such as a woven or non woven Nylon™, or another low surface energy (LSE) fabric, such as canvas, cotton, polyester or blends of polymer fabrics like the polypropylene and polyethylene previously mentioned. For example, a woven or non-woven polyamide fabric, known as Nylon™ made by various suppliers using fibers from E.I. DuPont of Wilmington, Del. could be used. A Cordura Nylon™ is a usable fabric for use in the system. Parachute like material could be used in an embodiment.

In an embodiment, a very thick fabric could be used as a portable tent or portable camp cover, whereas a less thick material could be used for application to a sandwiched or layered hard body armor component, made from fiberglass or a composite of ceramic made by one of a variety of companies, such as Cerco from Ohio or Ortech of Texas, or another tough, lightweight, bullet resistant material, such as a graphite composite. It is also contemplated that the ballistic material could be applied to a portion of a building, such as by covering a window to prevent damage and injury caused by fragmentation of the window due to bullets, explosives, debris, and inclement weather.

If the fabric is a woven fabric, it is contemplated that a usable woven fabric would have a denier ranging from 400 to 1000 denier. An example of a usable 500 denier woven Nylon is 500×500 denier textured nylon.

In an embodiment, the fabric is air textured on at least one side. Air texturing enhances adhesion, appearance, and provides some additional thickness to the fabric. Air texturing is typically created by roughing the surface of the fabric using abrasion.

Next, the dyed fabric can be coated with an acrylic based adhesive using a roll coating device, such as a wet spread coater, made by Black Clawson. The acrylic based adhesive can be applied on either side of the dyed fabric, forming a dyed, coated fabric. The acrylic based adhesive is uniquely useful, because the acrylic adhesive is a pressure sensitive adhesive, retains its elasticity throughout the assembly process, and does not dry hard during assembly of the fabric on a substrate, or between substrate layers. An acrylic adhesive called SCAPA UP2040, made by SCAPA of Connecticut, is contemplated to be particularly useful within the scope of the invention. Cold adhesive can be directly cast on a film. Alternatively, a film can be cast onto a liner, or the adhesive can be made into cast rolls of adhesive, such as SCAPA Unifilm UP2040, for application to the fabric.

It is also contemplated that an additive can be mixed into the acrylic adhesive prior to application to the fabric, such as a flame retardant. For example, Nonex, made by DuPont of Delaware, could be added in amounts ranging from 0.1% to 25% by weight of the adhesive.

Other additives can also be mixed into the adhesive, such as fillers, to lower the cost of the manufacturing process, including talc, which can be added in amounts ranging from 0.2% and 15% by weight of the total adhesive formulation.

Still other components, such as antioxidants, stabilizers, flexibility enhancers, plasticizers, and combinations thereof can be added to the adhesive formulation. It is contemplated that these additives can be added in amounts ranging from 0.1% and 5% by weight of the total adhesive formulation.

In an embodiment, the acrylic based adhesive can be clear, enabling inspection of the fabric for tears or holes, which can help to ensure the safety of an armored soldier. It is important to ensure that the fabric has at least 98% integrity, and lacks rips, tears, or holes. An exemplary clear acrylic is P-1076 available from SCAPA.

In another embodiment, the adhesive can be white or colored, such as bright orange, so that the adhesive layer can be inspected to ensure that a continuous layer, having 100% coverage, is used on the fabric. The adhesive layer can also help retard of a bullet's travel through the fabric, better protecting soldiers, law enforcement officials, and others.

If pigment is used, it is contemplated that up to 10% by weight of the adhesive formulation can include pigment.

The acrylic adhesive in an embodiment can be spread on the fabric in a thickness ranging from one mil to ten mils, preferably about three mils for sufficient adhesion.

Prior to application, the acrylic adhesive can be mixed in a mixer, such as a Banbury mixer or a low speed mixer.

It is contemplated that the roll coating device could be computer controlled, and in communication with a main processor, for enabling a continuous feed from the dye machine to the coating machine, ensuring continuous quality control and minimizing the amount of time needed to make the fabric. The roll coating device could also be in communication with the main processor though a network, such as a wireless network.

In yet another embodiment, it is contemplated that two different acrylic adhesives could be used, a first applied to the fabric and a second having a slightly different composition applied to the first acrylic adhesive, to provide two different physical property characteristics to the material. For example, one adhesive could aid removal of the subsequently applied liner, while the other provides additional flexibility to the ballistic material. For example, a second adhesive can contain a small amount of urethane, such as up to 10% by weight.

The present system includes an extruder for placing a liner over the acrylic based adhesive, forming a coated lined fabric. It is contemplated that the liner will have the same shape and dimensions as the coated lined fabric. In an embodiment, it is contemplated that the liner could extend beyond the fabric.

The liner can be formed in an extruder and then pressed out. The extruder can be a XP Express extruder made by Davis Standard. It is contemplated that the extruder and accompanying press can be computer controlled and in communication with the main processor through the network, which can be wireless. This connectivity facilitates a shorter processing time.

The liner is contemplated to travel from the extruder to one or more nip rollers, such as U.S. Rubber Rollers, which pressurably apply the liner onto the adhesive side of the fabric in a continuous and fast manner. In a contemplated embodiment, the nip rollers can also include computer control devices which can communicate with the main processor through the network, which can be wireless.

The liner can be made from a number of materials, including a polyester film, such as Mylar or polyethylene terpthalate, available from DuPont, a coated paper, such as coated Kraft paper, available from Enterprise of Illinois, another polymer film, such as a polypropylene, a polyethylene film, or a polypropylene-polyethylene copolymer film. The liner should have sufficient crystallinity to ensure a level of stiffness for easy removal, but enough flexibility that the liner can be wound when the fabric is wound into bolts or rolls for ease of use during the manufacturing process. It is contemplated that a liner having a thickness of two mils can be used, but the thickness can range from one mil to twenty mils, depending on the fabric being lined.

The present system is contemplated for use in an automated, generally computer driven process, wherein fabric is unwound from spools or bolts of fabric on a machine at a rate ranging from about 100 feet to about 1000 feet per minute, while the adhesive is cast or rolled on the fabric automatically. After the adhesive is applied, the fabric and the liner, which can be extruded from an extruder if it is a polymer or unwound from bolts of paper if it is paper, can be introduced to nip rollers and moved at the same speed as the fabric, disposing the liner on the fabric while matching the exact size and shape of the fabric. The combination of fabric with adhesive and liner can then be rolled into rolls of any size, such as 3000 feet.

If the liner is kraft paper, it can be a polycoated kraft paper, which has a polymer coating ranging from about one mil to five mils. Alternatively, the liner can be a transparent film having a thickness ranging from 0.5 mils to four mils, permitting visual inspection of the adhesive side of the fabric layer for quality control. The liner can be made from a polyethylene terpthalate, providing a thin, clear, or substantially transparent film, such as 90% transparent.

In an embodiment, a "crack-and-peel" feature can be cut into the liner for fast removal of the liner when the finished ballistic fabric is applied to a substrate. The creation of a "crack-and-peel" feature includes cutting a scored or continuous incision in the liner without cutting or penetrating the fabric. The "crack-and-peel" feature can be formed by using a blade to score the liner. A die cutter, such as those made by Mark Andy of Missouri or a Heat Treated model from Avis Roto Die of Los Angeles, could be positioned after the liner is applied, for making a single cut in the liner.

A blade of the die cutter, such as an underscore die attached along the fabric's path, can be used to create a long cut as the liner moves over the blade. This can be part of the computer driven automated process described previously, using one or more processors in communication with a network and a main server.

It is possible that the die cutter could be moved vertically, intermittently contacting the liner. This movement can be computer controlled by a processor connected to the die cutter for controlling a motor for moving the die cutter or the blade. It is important that during the automated process, the blade of the underscore die is positioned to cut only the liner without penetrating the fabric.

After lining the fabric and making the "crack-and-peel" feature, the fabric can be formed into bolts or rolls which can then be cut into one or more desired roll sizes using one or more displacement slitters, such as LS 1500 displacement slitters made by Lever of New Jersey.

It is contemplated that the present system can include using a main processor, such as one in a server connected to a network. The network can be the Internet, a cellular network, another wireless network, a fiber optic network, a local area network, a wide area network, or a similar network. It is contemplated that from a client device, such as a personal digital assistant, a cellular telephone, a computer, including a laptop, or other devices, instructions can be communicated from an operator or other user via the network to one or more processors controlling the automated machines. Each machine can have an individual processor that communicates via the network to the main processor. The main processor for running the automated machinery can communicate with main data storage containing computer instructions that enable the entire system to perform an automated sequential method, wherein each of the pieces of machinery used in the process is connected together on the network to which the main processor is connected. This can allow a user to quickly and easily operate the entire set of machines from a single personal digital assistant, cellular telephone, or remote computer, from a safe location, while enabling the ballistic material to be created.

It is contemplated that the present system can enable the production of the ballistic material at a rate of at least 100 feet per minute. Another embodiment contemplates a very fast production rate of lined ballistic material, at a rate ranging from 100 feet to 1000 feet per minute.

The present system also includes an inline fabric printer for inline printing of the fabric. If die cutting of the liner is being performed, it is contemplated that the fabric could be printed at the same time. The printer for the inline printing is contemplated to be capable of very fast production of the lined ballistic material, at a rate ranging from 100 feet to 1000 feet per minute, at the same rates as the lined fabric.

The printer, in another embodiment could be one that performs batch printing, such as during screen printing of the fabric.

In another embodiment, the step of printing can include depositing a bar code, a serial number, or combinations thereof on the fabric, such as by printing, by adhering, or by pressure application. A radio frequency identification tag (RFID) can also be deposited on the fabric.

The serial numbers, bar codes, RFID tags, and combinations of these tracking devices can be placed on the lined fabric for ease of tracking the resultant ballistic material during transit, within three meters, continuously using additional global positioning and other tracking devices.

The printing can be performed using one or more types of acrylic inks, including a solvent based ink, such as WA-14450 made by Wikoff of Kansas. It is also contemplated that an aqueous based ink or an ultraviolet ink can be used.

It is contemplated that the printing of the cut and lined fabric can be done using an inline printing process, such as using a flexographic printing press that can have a drum which is coated and covered by a screen mesh. Fabric is fed past the coated drum and mesh, which contacts the fabric, and the fabric is then printed. Flexo Printing™ specifically involves a rubber printing plate on a mandrel or similar roll further having a porous screen mesh that pulls the ink through the porous screen and deposits the ink on the surface of the fabric at a rate ranging from 100 to 500 feet per minute, preferably 300-500 feet per minute. A Mark Andy 4150

Flexopress made by Mark Andy of Kansas City, Kans. is contemplated as particularly usable herein.

The printing can be cured with one or more of the following cure techniques: ultraviolet light in the absence of heat, which saves considerably on energy costs, direct heat, or convection heat using moving heated air. This printing step with sequential curing step is contemplated to be used in the process prior to cutting the printed fabric.

This printing is expected to comply with the 1989 American Society for Testing and Materials (ASTM) Standards D 2805, for opacity, D 523, for gloss, D 1729, for color, and D 2369, for solids, as stated in Commercial Item Description A-A-208B.

After printing, the fabric can be cut in a shape. The cutting can be performed by using die cutters, such as a Mark Andy 4120, by laser cutting, such as by using a PCMC laser or a ruby laser, or combinations thereof. The resultant ballistic material can be up to 300% thicker than the flexible conformable low energy fabric.

The fabric, after dying, coating, lining, and printing is a flexible ballistic material that is easy to apply to a base substrate, such as a body armor component made from fiberglass, graphite composite, similar materials, or to open cell foam padding disposed on either side of the hard, bullet resistant impenetrable substrate. This allows for the creation of a component of padded, water resistant body armor that is comfortable to wear, but tough and durable in a corrosive environment. It is contemplated that ballistic material produced using the present system can be used in the presence of sand, such as in the desert, or in the presence of high velocity flying particles or similar rough materials, such as a soldier moving against a wall or rough jagged metal, without tearing, and without gouging or disintegrating the ballistic material.

To create a spall cover using ballistic material produced using the present system, an oversized front piece of fabric can be applied to a front side of a first open cell foam and wrapped over a substrate's side to cover a portion of a back side of a second open cell foam, then smoothed out. The fabric edge will overlap in the back, then a back piece can be applied on top of the front wrapped edge, creating a smooth finish. The fabric can then be heat sealed with a torch, a laser, a soldering iron, a soldering wire, or Toman™ heat staking equipment, creating a seamless edge forming a spall plate.

The spall cover produced using the present system can have a shelf life of at least one year or more from the date of shipment, if stored in a cool dry place below 76 degrees Fahrenheit. A spall cover produced using the present system can help to prevent injury to soldiers due to fragmentation of body armor components upon impact. The present spall cover can further be used to cover and protect military vehicle and aircraft seating.

In an embodiment, body armor can be created using an assembly device also in communication with the main processor.

In yet another embodiment, it is contemplated to include the step of applying a urethane coating to a surface of the flexible conformable fabric. This additional urethane coating can be a thin coating of fast drying polyurethane, such as having a thickness ranging from one mil to three mils, that can dry almost as quickly as it is applied. The coating can be applied to the fabric after dyeing. An exemplary polyurethane coating can be a polyurethane coating available from Amerabelle, and can be used for water proofing the fabric. It is possible that the urethane coating can be sprayed on the fabric in an amount equivalent to about 0.5 oz to 0.75 oz per square yard of fabric.

It should be noted that the invention does not require urethane in all embodiments, and some embodiments without the urethane can be at least 20% less expensive to make than the embodiments that include a urethane coating.

In a particular embodiment of the invention, the present system is used to create a ballistic material having a total thickness of 19 mils, which includes an adhesive thickness of 2 mils, a fabric thickness of 15 mils, and a liner thickness of 2 mils. This embodiment can use a clear adhesive which passes a peel adhesive test using PSTC method #101 of Illinois—at 180 degrees initial to SS (20 min @RT) which yields at 32 inches per ounce and a holding power using PST Method #107 at 178 degrees of 23.2 PSI (1 inch×1 inch×1000 g) at RT, which was greater than 24 hours.

Additionally, it is contemplated that one or more components of outer body armor can be created by using the ballistic material made using the present system. The ballistic material can be disposed over a base structure of a substrate, such as a ceramic, a fiberglass, other durable crystalline polymers, or a graphite composite can be created and sandwiched between two foam layers made from different materials. The two foam layers can include a soft layer to contact with a soldier's body and an outer layer to support deflection of bullets and resist impacts of blunt instruments, such as rocks, rifle butts, shrapnel, debris, or fists of militant people.

It is contemplated that the ballistic material, once applied to the substrate and foam combination, can be sealed, such as heat sealed with a torch, to prevent water or other materials from entering through seams in the fabric.

FIG. 1 depicts an embodiment of the present system. Means for dying fabric (10) are depicted in communication with roll coating device (12) for continuously coating an acrylic adhesive on a top surface of the dyed fabric. Mixer (28) is depicted in communication with roll coating device (12) for premixing the adhesive, which can contain additives, flame retardants, and similar materials. Roll coating device (12) is in communication with an extruder (14) for casting a liner. Extruder (14) is connected to nip rollers (16) for receiving the coated dyed fabric and pressing the liner to the dyed fabric.

Displacement slitters (18) are depicted in communication with nip rollers (16) for receiving the lined and coated fabric and cutting it to a designated size. Fabric printer (20) is depicted in communication with displacement slitters (18) for printing the lined fabric, and a continuous cutter (22) is in communication with fabric printer for cutting desired shapes from the fabric.

FIG. 1 also depicts a cure component (23) associated with fabric printer (20). Coater (24) is depicted in communication with nip rollers (16) for applying a urethane coating to a surface of the fabric opposite the surface of the adhesive. Die cutter (26) is also depicted in communication with nip rollers (16) for forming a "crack-and-peel" feature in the liner. Coater (24) and die cutter (26) are optional and either or both coater (24) and die cutter (26) may be omitted from the system.

While these embodiments have been described with emphasis on the embodiments, it should be understood that within the scope of the appended claims, the embodiments might be practiced other than as specifically described herein.

What is claimed is:

1. A system for making a ballistic material resistant to penetration from bullets, shrapnel, debris, and other lethal missiles, comprising:

means for dyeing a flexible conformable low surface energy fabric, forming a dyed fabric, wherein the flexible conformable low surface energy fabric has a first thickness of at least three mils;

a roll coating device for continuously coating a top surface of the dyed fabric with an acrylic based adhesive, forming a coated fabric;

an extruder for applying a liner to the coated fabric;

at least one nip roller for receiving the liner and the coated fabric simultaneously and pressurably applying the liner to the coated fabric, forming a coated lined fabric;

at least one displacement slitter for receiving the coated lined fabric and cutting the coated lined fabric into at least one desired size, forming a cut lined fabric;

a fabric printer for printing the cut lined fabric with a fast drying acrylic ink, forming a ballistic material having a second thickness up to 300% larger than the first thickness and which is tough, resistant to bullet penetration from a range of six feet from the ballistic material; and a continuous cutter for cutting the ballistic material into a desired shape.

2. The system of claim 1, wherein the means for dying, the roll coating device, the extruder, the at least one nip roller, the at least one displacement slitter, and the fabric printer are connected for performing a continuous process.

3. The system of claim 2, wherein the continuous process is managed by a processor connected to a network.

4. The system of claim 3, wherein the means for dying, the roll coating device, the extruder, the at least one nip roller, the at least one displacement slitter, and the fabric printer are in wireless communication with the network and the processor.

5. The system of claim 1, wherein the fabric printer deposits a member of the group consisting of: a bar code, a radio frequency identification tag, a serial number, or combinations thereof, on the cut lined fabric.

6. The system of claim 1, wherein the fabric printer is a flexographic printing press.

7. The system of claim 6, wherein the fabric printer comprises a curing component for curing the fast drying acrylic ink using ultraviolet light, direct heat, or convection heat.

8. The system of claim 1, further comprising a coater for applying a urethane coating to a surface of the flexible conformable low surface energy fabric.

9. The system of claim 1, wherein the continuous cutter is a die cutter, a laser cutter, or combinations thereof.

10. The system of claim 1, further comprising a die cutter for forming a "crack-and-peel" feature in the liner.

11. The system of claim 1, further comprising a mixer for mixing a flame retardant, at least one additive, or combinations thereof into the acrylic based adhesive prior to coating the dyed fabric with the acrylic based adhesive.

* * * * *